US008099970B2

(12) United States Patent
Cho et al.

(10) Patent No.: US 8,099,970 B2
(45) Date of Patent: Jan. 24, 2012

(54) REFRIGERATOR DOOR OPENING DEVICE AND CONTROL METHOD THEREOF

(75) Inventors: Sung Ho Cho, Gwangju (KR); Jae Koog An, Gwangju (KR); Chang Hem Lee, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 657 days.

(21) Appl. No.: 11/984,313

(22) Filed: Nov. 15, 2007

(65) Prior Publication Data

US 2008/0134698 A1 Jun. 12, 2008

(30) Foreign Application Priority Data

Dec. 8, 2006 (KR) ..... 10-2006-0124758
Dec. 11, 2006 (KR) ..... 10-2006-0125671

(51) Int. Cl.
*F25D 29/00* (2006.01)

(52) U.S. Cl. ..... 62/131; 62/449

(58) Field of Classification Search ..... 62/131, 62/449

See application file for complete search history.

(56) References Cited

U.S. PATENT DOCUMENTS 5,988,709 A * 11/1999 Lee et al. ..... 292/199
7,082,380 B2 * 7/2006 Wiebe et al. ..... 702/182
2002/0121784 A1 * 9/2002 Chevalier ..... 292/201
2005/0134473 A1 * 6/2005 Jang et al. ..... 340/691.1
2006/0097612 A1 * 5/2006 Park ..... 312/405
2006/0107597 A1 * 5/2006 Jin et al. ..... 49/149
2008/0083243 A1 * 4/2008 Lee et al. ..... 62/446

FOREIGN PATENT DOCUMENTS

CN 1769824 A 5/2006
KR 10200640436 5/2006

OTHER PUBLICATIONS

Chinese Office Action for corresponding Chinese Patent Application No. 200710196109.7 dated Dec. 26, 2008 (3 pgs).

* cited by examiner

*Primary Examiner* — Cheryl J Tyler
*Assistant Examiner* — Jonathan Bradford
(74) *Attorney, Agent, or Firm* — Staas & Halsey LLP

(57) ABSTRACT

A refrigerator including a door opening device to easily open a door and a control method thereof are disclosed. The device opens doors using rotation of a driving motor, returns to an initial state without rotating the driving motor in reverse after opening doors, and opens doors using only forward and reverse rotation of driving motor when doors are sequentially opened. Moreover, position of rotation cam is detected at initial state when power is supplied or during operation to determine whether the device is malfunctioning. In the early time when position of the rotation cam is detected, the driving motor is rotated by force so that malfunction of driving motor due to chattering is prevented. Frequency of opening doors by a door opening signal is determined and the device is driven in a mode so that damage is prevented due to excessive operation.

33 Claims, 11 Drawing Sheets

REFRIGERATOR DOOR OPENING DEVICE AND CONTROL METHOD THEREOF

CROSS-REFERENCE TO RELATED APPLICATIONS

This application claims the benefit of Korean Patent Application Nos. 10-2006-0124758 and 10-2006-0125671, respectively filed on Dec. 8 and 11, 2006, in the Korean Intellectual Property Office, the disclosures of which are incorporated herein by reference.

BACKGROUND

1. Field

The present invention relates to a refrigerator and a control method thereof, and particularly, to a refrigerator including a door opening device to easily open a door and a control method thereof.

2. Description of the Related Art

In general, since a door to open and close large refrigerator compartments is also large, a strong force is required to open the door. Not only is the door heavy, but there is a difference between interior temperature and outer temperature of the compartment due to a temperature drop of the compartment when the refrigerator is operated. Thus, recently, a door opening device has been installed to the refrigerator to push a door in the opening direction when opening the door.

Korean Unexamined Patent Application Publication No. 2006-40436 discloses a refrigerator including a door opening device. This refrigerator is a side by side refrigerator including compartments partitioned at both sides thereof and a left door and a right door to open and close the respective compartments. The opening device includes a driving motor to rotate forward and backward, and a main cam rotated by the driving motor. The door opening device further includes a first sub-cam driven by the main cam to open the left door and a second sub-cam driven by the main cam to open the right door.

The door opening device opens the left door by which, due to the rotation of the driving motor, the main cam rotates clockwise to drive the first sub-cam. Due to the reverse rotation of the driving motor, the main cam rotates counterclockwise to drive the second sub-cam, resulting in opening the right door.

However, since this door opening device drives the main cam by the forward rotation of the driving motor clockwise and returns the main cam to an initial position by the reverse rotation of the driving motor counterclockwise after opening the door, the driving motor must be rotated twice to open a single door. In other words, the driving motor must rotate forward and in reverse. Thus, in the door opening device, since the driving motor is frequently driven, the lifespan of the driving motor and a relay to control the driving motor could be shortened.

Moreover, in a case of opening one of the doors and opening the other door thereafter, in order to open one of the doors, the driving motor is driven according to rotating in a first direction, rotating in a second direction opposite to the first direction to be returned to the initial position, further rotating in the second direction to open the other door, and rotating in the first direction to be returned to the initial position. Thus, in this case, the driving motor is frequently driven and the opening of the doors is delayed.

SUMMARY

Accordingly, it is an aspect of the present invention to provide a refrigerator having a door opening device in which the number of driving operations of a driving motor to open a door is reduced and thus life spans of the driving motor and related components are lengthened, and a control method thereof.

Another aspect of the invention is to provide a refrigerator in which it is determined whether a door opening device is malfunctioning and malfunction of a driving motor due to chattering of a driving motor driving unit is prevented, and a control method thereof.

Still another aspect of the invention is to provide a refrigerator in which a door opening device is prevented from damage due to excessive operation thereof and a control method thereof.

Additional aspects and/or advantages will be set forth in part in the description which follows and, in part, will be apparent from the description, or may be learned by practice of the invention.

The foregoing and/or other aspects are achieved by providing a refrigerator comprising a main body defining first and second compartments therein; first and second doors to respectively open and close the first and second compartments; a door opening device comprising: a switch to input a plurality of door opening signals respectively corresponding to the first and second doors to respectively open the first and second doors, an actuating member to rotate to selectively open the first and second doors, a rotation cam including a plurality of protrusions to contact and rotate the actuating member and a plurality of spacing portions spaced apart from the actuating member, the protrusions and the spacing portions being alternately disposed in a rotation direction, a driving motor to rotate the rotation cam forward and in reverse, and a return device to return the actuating member to an initial position after opening one of the first and second doors; and a controller to control the door opening device in accordance with the door opening signals when the door opening signals are inputted to the switch.

Moreover, the controller accepts only a first inputted one of the door opening signals when both the plurality of the door opening signals for the first and second doors are inputted, and rotates the driving motor in a first direction in order to open the door corresponding to the accepted door opening signal.

Moreover, the controller disregards the door opening signals for the first and second doors when the door opening signals are inputted simultaneously.

Moreover, the controller accepts only the door opening signal corresponding to a preset one of the first and second doors when the door opening signals are inputted simultaneously.

Moreover, when the accepted door opening signal is inputted during the rotation of the driving motor, the controller disregards the inputted door opening signal.

The refrigerator further comprises a door opening sensor to detect whether the doors are opened, and the controller disregards the inputted door opening signal when the door opening sensor detects the door corresponding to the inputted door opening signal.

The door opening device further comprises a position detecting unit to detect a rotation position of the rotation cam to control the driving motor, the position detecting unit having a portion contacting the protrusions during the rotation of the actuating member and being positioned opposite a first one of the protrusions of the rotation cam at the initial state when the door opening signal is not accepted, and the controller determines the rotation position of the rotation cam detected by the position detecting unit when any one of the door opening signals is accepted, and rotates the driving motor in the first direction such that the rotation cam rotates until the protrusion adjacent the first one of the protrusions is opposite the position detecting unit.

The position detecting unit comprises magnets disposed at leading edges of the respective protrusions and a detecting sensor installed to an outer side of the rotation cam to detect the magnets.

The refrigerator further comprises a display to display a malfunction of the door opening device, and the controller determines the door opening device has malfunctioned when the protrusion adjacent to the first protrusion is not detected within a first predetermined time and controls the display to display the malfunction.

The controller rotates the driving motor for a second predetermined time before detecting the rotation position of the rotation cam when the door opening signals are accepted.

The controller disregards the rotation position of the rotation cam for a third predetermined time and rotates the driving motor in the first direction when the spacing portions are detected during the rotation of the driving motor.

When electric power is supplied to the refrigerator, the controller rotates the driving motor in either the first or second direction until the protrusion adjacent to the first protrusion is detected for an initial malfunction diagnosis.

When the protrusion adjacent the first protrusion is not detected within the first predetermined time during the initial malfunction diagnosis, the controller determines the door opening device malfunctioned and controls the display to display the malfunction.

The controller, in the initial malfunction diagnosis, first rotates the driving motor for the second predetermined time before detecting the rotation position of the rotation cam.

The controller determines a frequency of the opening of the doors due to the door opening signals inputted to the switches during the control of the door opening device, and when the frequency is greater than a fourth predetermined time, the controller performs a locking mode of the door opening device that the door opening device is not operated even when the door opening signals are inputted.

When the door opening signals are not inputted for a fifth predetermined time while the locking mode of the door opening device is performed, the controller performs a driving mode of the door opening device that the locking mode of the door opening device is released and the door opening device is driven in accordance with an inputted door opening signal.

The refrigerator further comprises an input unit to input any one operation mode of the locking mode and the driving mode of the door opening device, and when the operation mode is inputted to the input unit by a control signal of a user, the controller firstly performs the inputted operation mode regardless of the frequency that the doors are opened by the door opening signals.

When the locking mode or the driving mode of the door opening device is performed, the controller controls the display to display the performing operation mode.

The foregoing and/or other aspects are achieved by providing a method of controlling a refrigerator comprising: a main body defining first and second compartments therein; a first door and a second door to respectively open and close the first and second compartments, a door opening device comprising: a switch to input a plurality of door opening signals respectively corresponding to the first and second doors to respectively opening the first and second doors, an actuating member to rotate to selectively open the first and second doors. a rotation cam including a plurality of protrusions to contact and rotate the actuating member and a plurality of spacing portions spaced apart from the actuating member, the protrusions and the spacing portions being alternately disposed in a rotation direction, a driving motor to rotate the rotation cam forward and in reverse, and a return device to return the actuating member to an initial position after opening one of the first and second doors, the method comprising: controlling the door opening device in accordance with the door opening signals when the door opening signals are inputted to the switch.

When the plurality of the door opening signals for the first and second doors are inputted, the method further comprises accepting only a first inputted one of the door opening signals and rotating the driving motor is rotated in a first direction in order to open the door corresponding to the accepted door opening signal.

The door opening signals for the two doors or accepting only one of the door opening signals comprises presetting one of the two doors when the door opening signals are inputted simultaneously.

When the door opening signal is inputted during the rotation of the driving motor, the method further comprises disregarding the inputted door opening signal.

Based upon whether a door corresponding to the inputted door opening signal is opened, and if the corresponding door is opened, the inputted door opening signal is disregarded.

The door opening device further comprises a position detecting sensor to detect a positing of the rotating cam, the position detecting sensor being opposite a first one of the protrusions when the door opening signal is accepted, and the method further comprises detecting the rotation position of the rotation cam, and the driving motor is rotated in a first direction such that the rotation cam rotates until a second one of the protrusions is opposite the position detecting sensor, the second protrusion being adjacent the first protrusion.

The position detecting unit comprises a detecting sensor, installed to an outer side of the rotation cam, the method further comprising detecting magnets disposed at leading edges of the respective protrusions.

When the second protrusion is not detected within a first predetermined time, the method further comprises determining that the door opening device is malfunctioning and the malfunctioned state is displayed.

When the door opening signals are accepted, the method further comprises rotating the driving motor for a second predetermined time before detecting the rotation position of the rotation cam.

The method further comprises when the spacing portions are detected during the rotation of the driving motor, disregarding the rotation position of the rotation cam for a third predetermined time and rotating the driving motor in the first direction.

When electric power is supplied to the refrigerator, the method further comprises performing an initial malfunction diagnosis while rotating the driving motor in any direction until the second protrusion disposed next to a current position is detected.

When the second protrusion is not detected within the first predetermined time during the initial malfunction diagnosis, the method further comprises determining that the door opening device is malfunctioning and the display displays the malfunction.

The method further comprises rotating during the performing the initial malfunction diagnosis, the method further comprises rotating the driving motor is for the second predetermined time before detecting the rotation position of the rotation cam.

When the frequency of the opening of the doors due to the door opening signals is determined during the control of the door opening device, and the frequency is greater than a fourth predetermined time, the method comprises not operating a locking mode of the door opening device even when the door opening signals are inputted.

When the door opening signals are not inputted for a fifth predetermined time while the locking mode of the door opening device is performed, the method comprises performing a driving mode of the door opening device that the locking mode of the door opening device is released and the door opening device is driven in accordance with an inputted door opening signal.

When the operation mode is inputted by a control signal of a user, the method comprises performing the inputted operation mode first regardless of the frequency that the doors are opened by the door opening signals.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
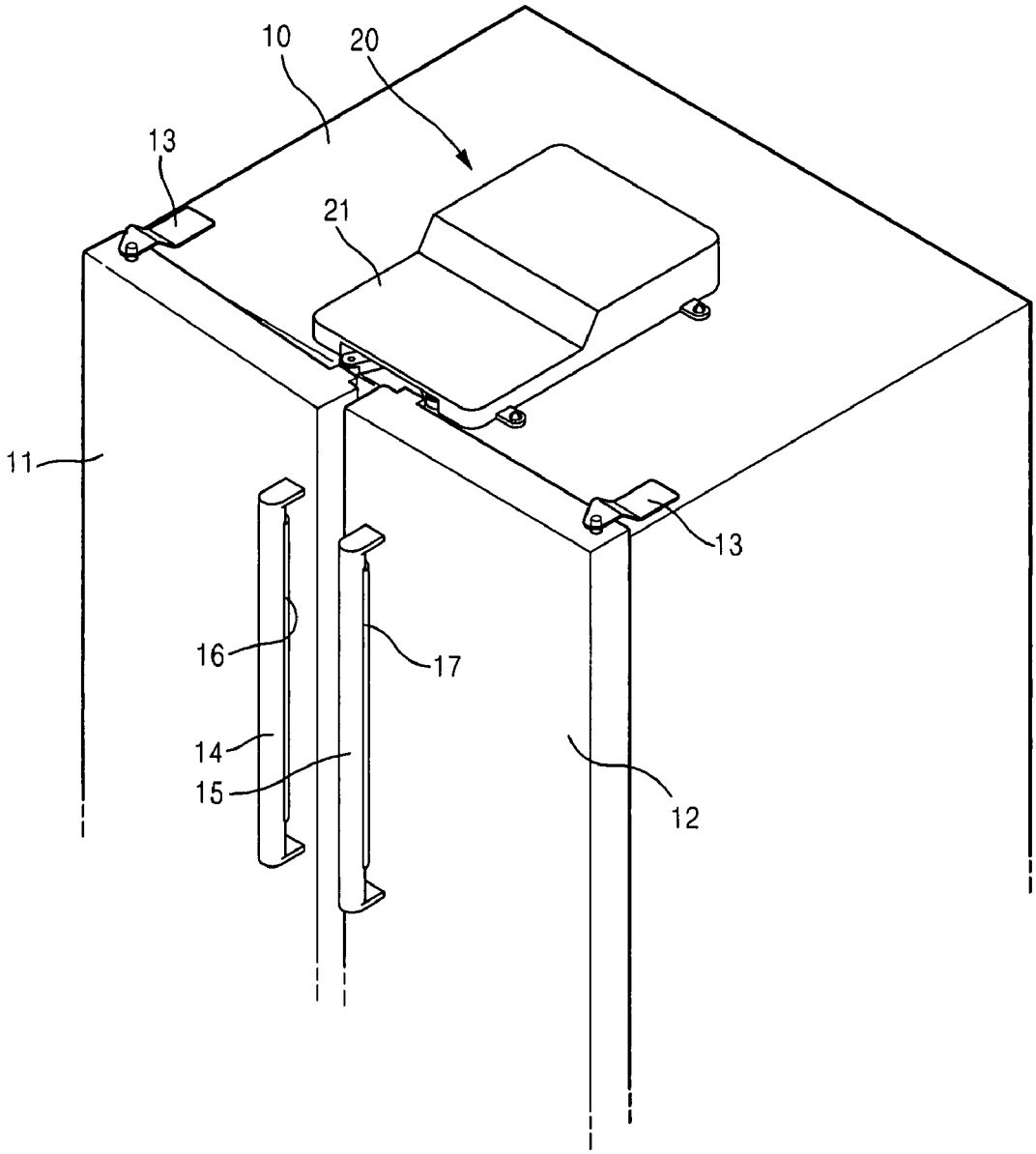
FIG. 1 is a perspective view illustrating a refrigerator employing a door opening device according to a first embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a perspective view illustrating a refrigerator employing a door opening device according to a first embodiment of the present invention. The refrigerator includes a main body which is partitioned into a first compartment (not shown) and a second compartment (not shown). To a front side of the main body 10, a first door 11 and a second door 12 are installed on sides of the main body 10 to open the first and second compartments, respectively. Generally, in the refrigerator, the first compartment forms a freezer compartment and the second compartment forms a refrigerator compartment. The first and second doors 11 and 12 are coupled with the main body 10 to be pivoted by hinges 13 at respective upper and lower sides. The respective doors 11 and 12 are provided with handles 14 and 15 formed in the front sides thereof.

A door opening device 20 is installed to an upper side of the main body 10. The door opening device 20 pushes the upper sides of the first and second doors 11 and 12 to open the respective doors 11 and 12 such that a user can easily open the doors.

Figure 6:
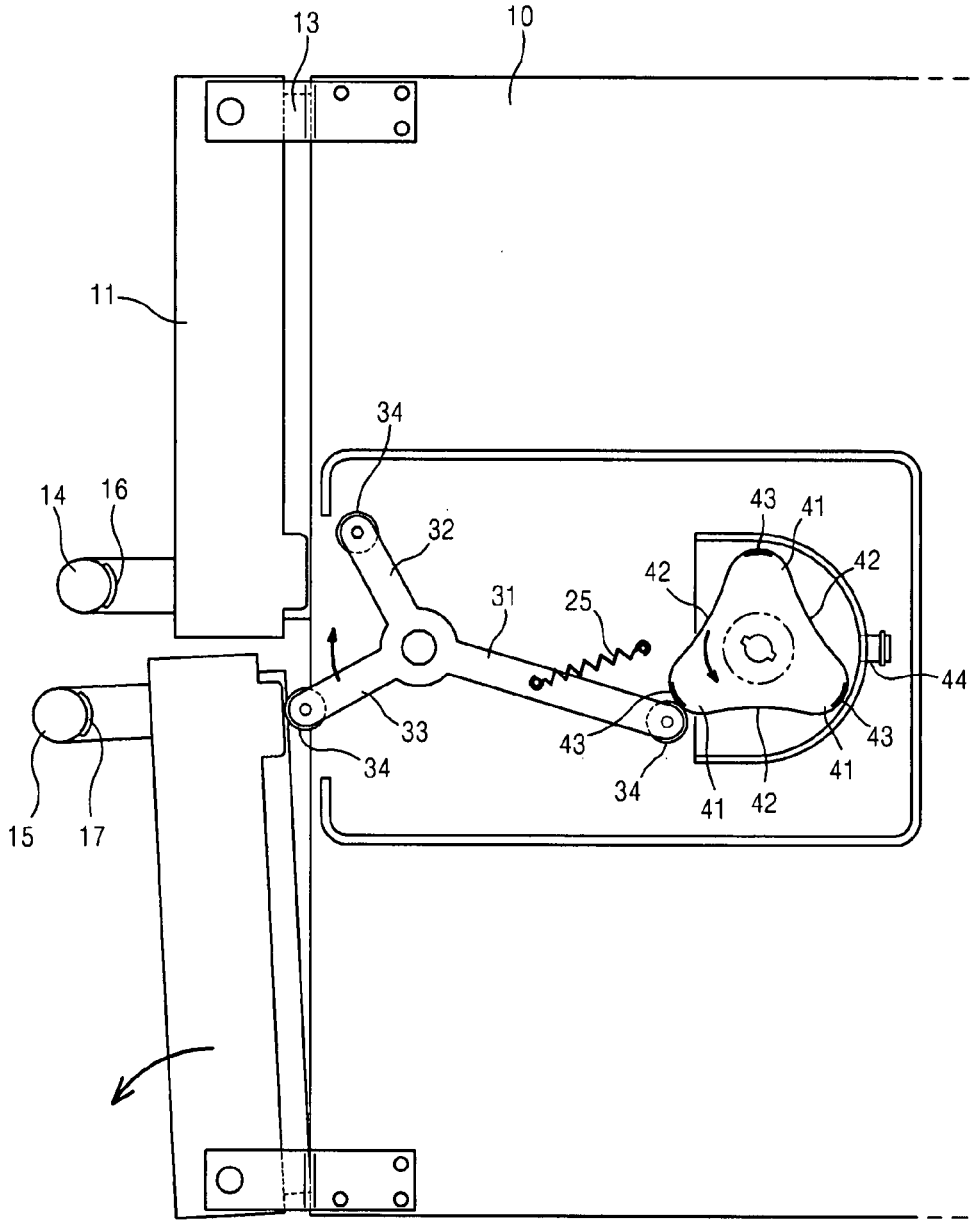
FIG. 6 is a plan view illustrating a second door being opened in the refrigerator employing the door opening device according to the first embodiment of the present invention.
Figure 7:
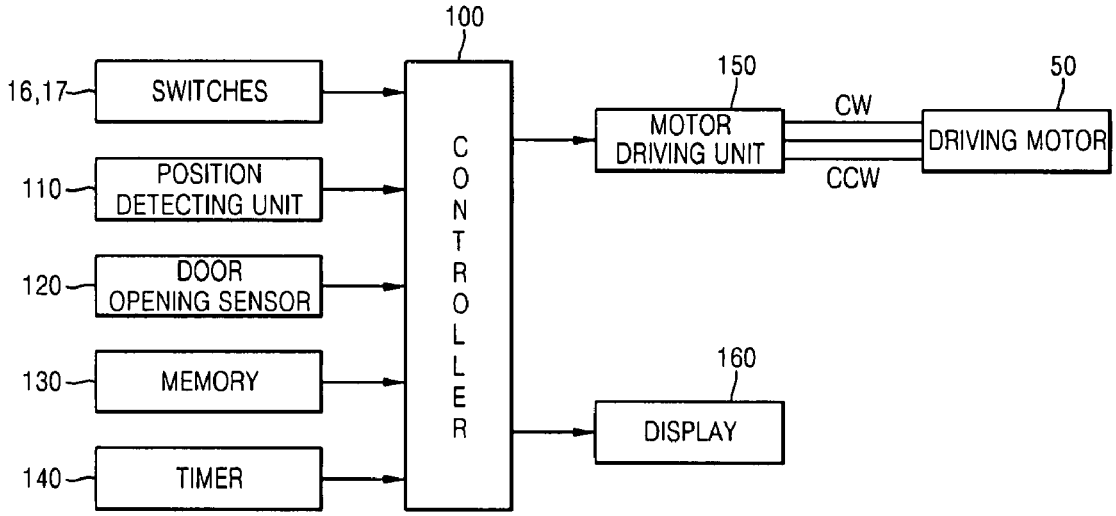
FIG. 7 is a block diagram illustrating control of operation of the door opening device according to the first embodiment of the present invention.

FIGS. 2 to 6 illustrate the door opening device 20 according to the first embodiment of the present invention, and FIG. 7 is a block diagram illustrating operation of the door opening device 20.

Figure 2:
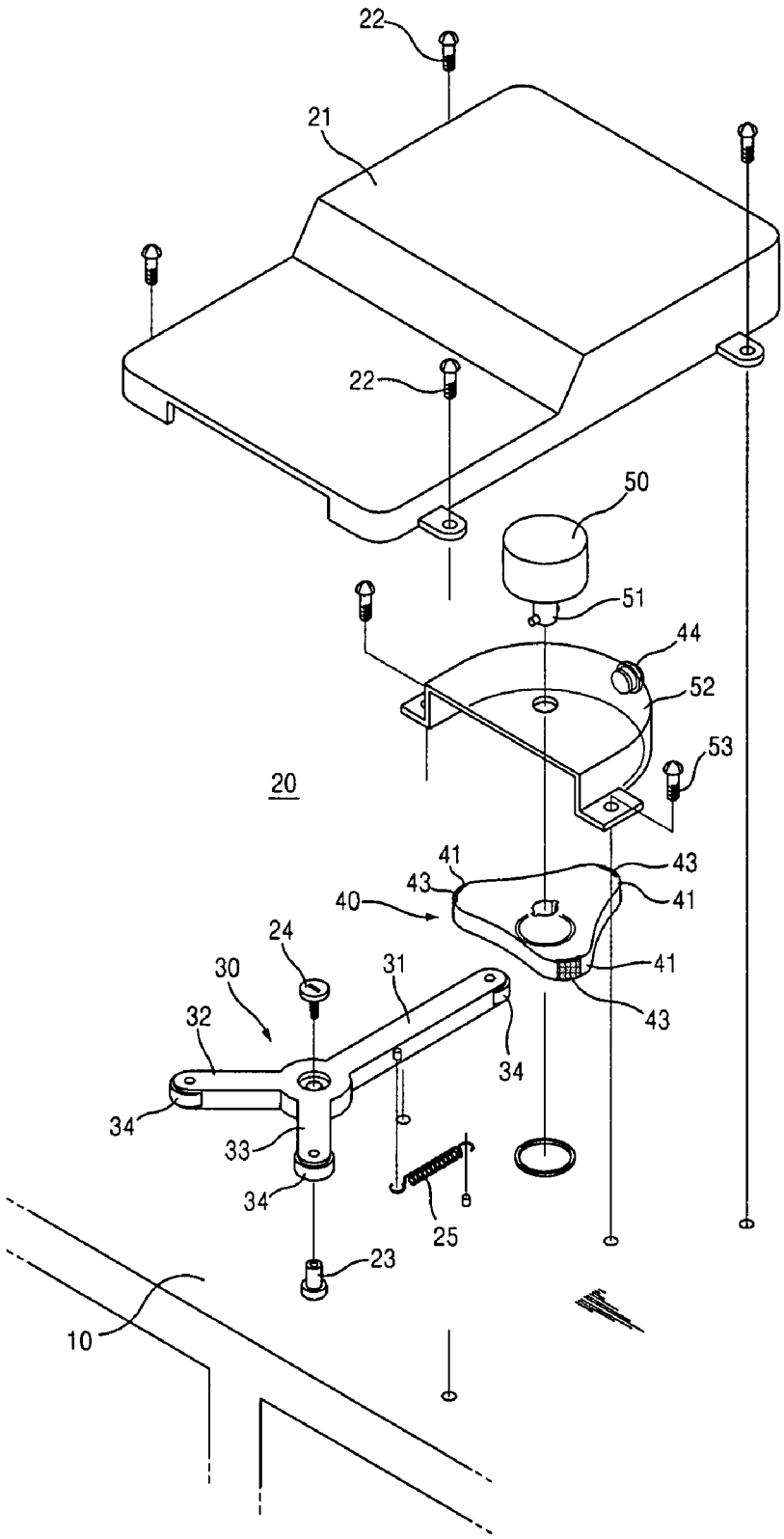
FIG. 2 is an exploded perspective view illustrating the door opening device according to the first embodiment of the present invention.
Figure 3:
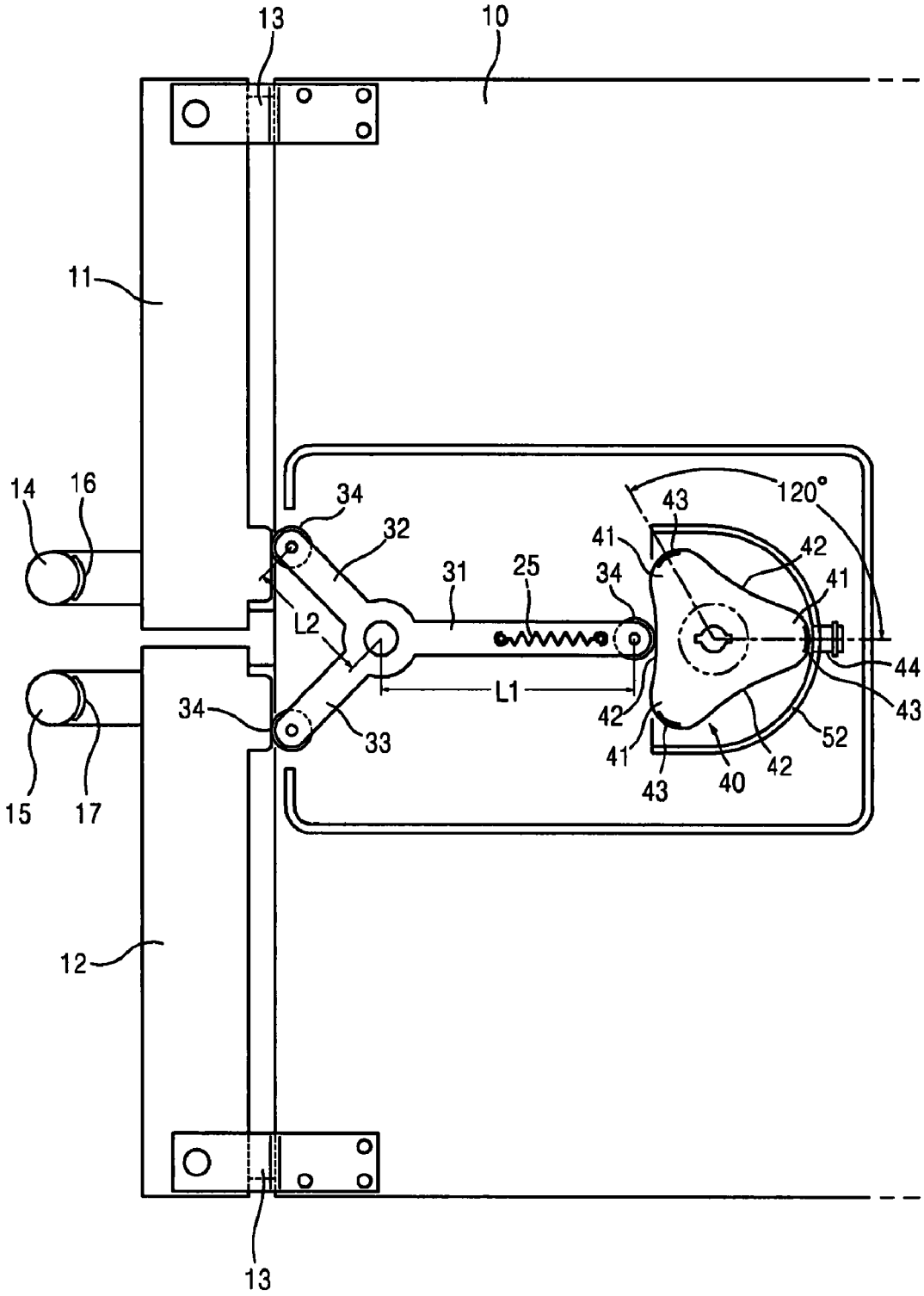
FIG. 3 is a plan view illustrating the doors closed in the refrigerator employing the door opening device according to the first embodiment of the present invention.

The door opening device 20, as illustrated in FIGS. 2 and 3, includes an actuating member 30 to selectively open the doors 11 and 12 by rotation, a rotation cam 40 to rotate the actuating member 30 for the opening of the doors 11 and 12, and a driving motor 50 to rotate the rotation cam 40 forward and in reverse. The door opening device 20 further includes a cam cover 52 to accommodate the rotation cam 40 and an upper cover 21 to cover the upper side of the device.

The rotation cam 40 includes three protrusions 41 to contact and rotate the actuating member 30 and three spacing portions 42 spaced apart from the actuating member 30. The respective protrusions 41 and spacing portions 42 are alternately disposed in the rotation direction, and the protrusions 41 are arranged every 120 degrees. The respective protrusions 41 have a convex curved shape and the respective spacing portions 42 have a concave curved shape.

In this embodiment, although the numbers of the protrusions 41 and the spacing portions 42 are, for example, three, different numbers of the protrusions 41 and the spacing portions 42 can be utilized so long as adequate performance can be carried out.

The cam cover 52 to accommodate the rotation cam 40 is fixed to the upper side of the refrigerator main body 10 by fastening fixing screws 53, and the driving motor 50 is fixed to the upper side of the cam cover 52. The shaft 51 of the driving motor 50 penetrates the cam cover 52 and extends into the cam cover 52 to be coupled with the rotation cam 40. Thus, the rotation cam 40 rotates within the cam cover 52 during the operation of the driving motor 50.

The actuating member 30 is coupled to the upper side of the main body 10 in front of the rotation cam 40. For the coupling, the main body 10, as illustrated in FIG. 2, includes a supporting shaft 23 provided on the upper side. A fastening screw 24 is fastened to the supporting shaft 23 to prevent the actuating member 30 from being separated after the coupling of the actuating member 30.

Figure 4:
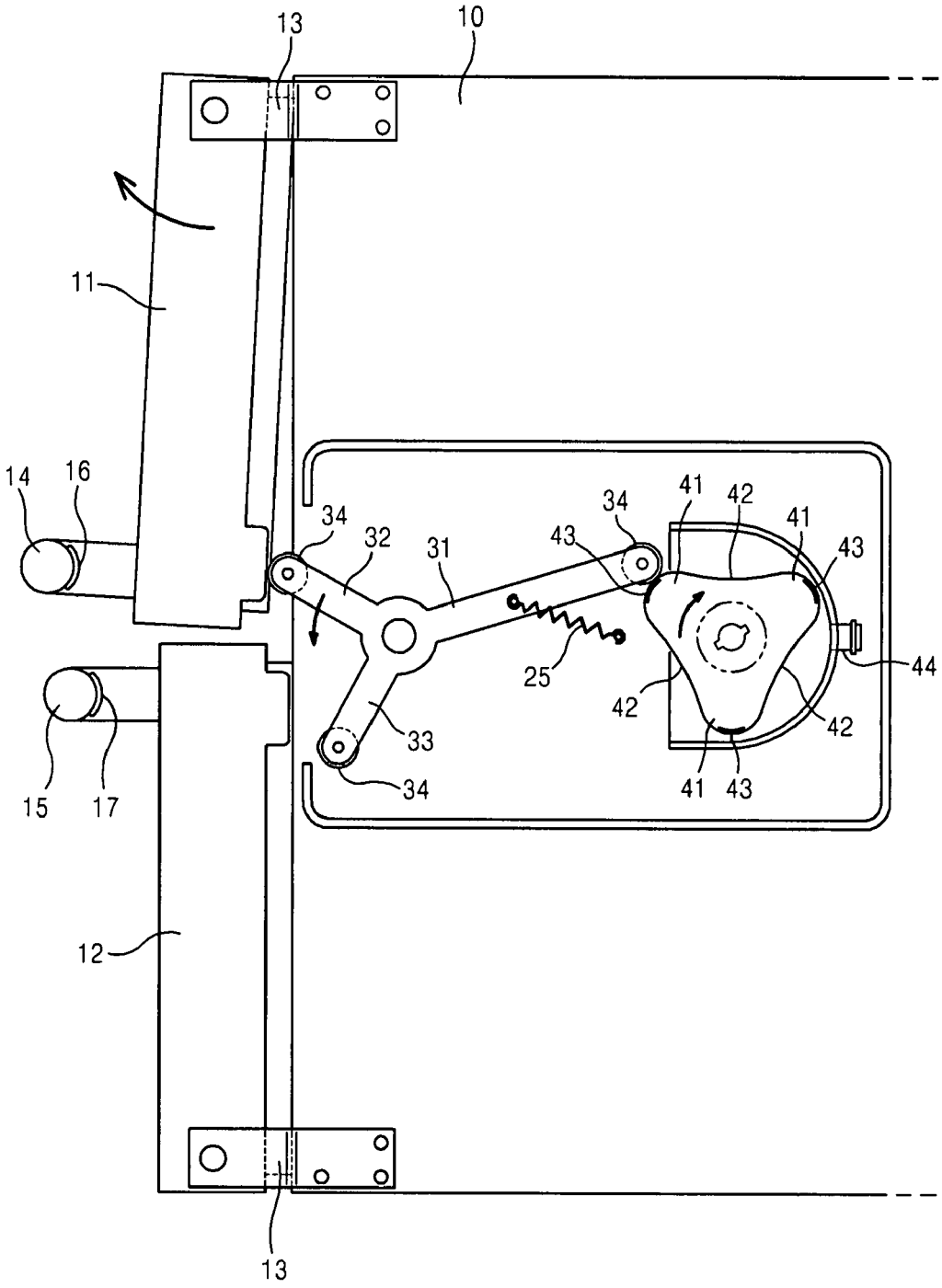
FIG. 4 is a plan view illustrating a first door being opened in the refrigerator employing the door opening device according to the first embodiment of the present invention.
Figure 5:
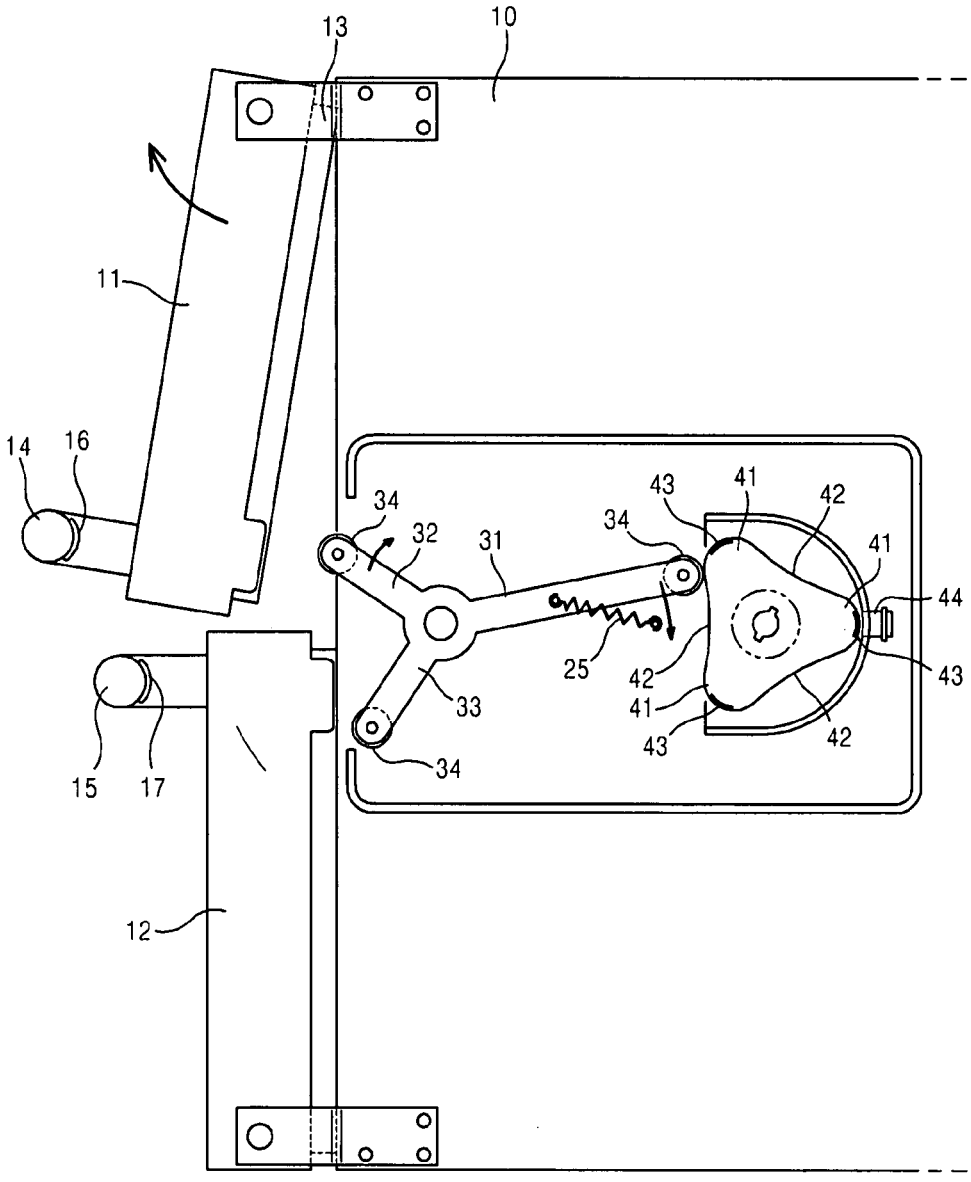
FIG. 5 is a plan view illustrating an actuating member of the door opening device returned to its initial position in the refrigerator employing the door opening device according to the first embodiment of the present invention.

The actuating member 30, as illustrated in FIG. 3, includes a first extending part 31 extended from a center of rotation to the rotation cam 40, a second extending part 32 extended inward from the center of rotation, and a third extending part 33 extended from the center of rotation to the inside of the second door 12. The actuating member 30 has a "Y"-shape. The first extending part 31 of the actuating member 30 contacts the protrusions 41 of the rotation cam 40 at its end, and has a length long enough to be spaced apart from the spacing portions 42 of the rotation cam 40. Moreover, a distance L1 from an end of the first extending part 31 of the actuating member 30 to the center of rotation is longer than a distance L2 from ends of the second and third extending parts 32 and 33 to the center of rotation. This is designed by applying the principle of the lever, as illustrated in FIGS. 4 and 6, such that the second extending part 32 or the third extending part 33 presses the inner surface of the first or second doors 11 or 12 with a large force to easily open the first and second doors 11 and 12 even when the rotation cam 40 rotates the first extending part 31 of the actuating member 30 with a small force.

The ends of the first, second, and third extending parts 31, 32, and 33 of the actuating member 30 are installed with rollers 34, respectively. This is to prevent friction between the first extending part 31 and the rotation cam 40 and friction between the second and third extending parts 32 and 33 and the first and second doors 11 and 12, when the door opening device 20 is driven. The first extending part 31 of the actuating member 30 is installed with a return spring 25 to return the actuating member 30 to an initial position after opening the doors.

The return spring 25 includes an end connected to the first extending part 31 and the other end connected to the upper side of the main body 10 to provide an elastic returning force to the first extending part 31. Although a coil type return spring 25 is depicted as a device to return the actuating member in the drawing, the device may be an elastic member such as a torsion spring, spiral spring, rubber, or the like.

As such, since the actuating member 30 receives the elasticity of the return spring 25, the actuating member 30, as illustrated in FIG. 3, returns to the initial position. Moreover, in the initial state, the end of the first extending part 31 is positioned at one of the spacing portions 42 of the rotation cam 40 and the driving motor 50 is stopped when positions of the spacing portion 42 and the first extending part 31 are the same.

To this end, the door opening device 20 includes a position detecting unit 110 to detect a rotation position of the rotation cam 40 to control the driving motor 50. The position detecting unit 110 includes magnets 43 disposed at leading edges of the protrusions 41 of the rotation cam 40 and position detecting sensor 44 fixed to the outer cam cover 52 to detect the magnets 43.

The position detecting sensor 44 may be a conventional reed switch, in this embodiment, as an example, the reed switch is turned on when the position detecting sensor 44 faces one of the magnets 43 of the protrusions 41, and is turned off when the position detecting sensor 44 faces one of the spacing portions 42, and vice versa.

Meanwhile, the position detecting unit 110 is not limited to the above-description, but may be a photo sensor to detect the positions of the protrusions 41, or a limit switch to detect the position by contacting the protrusions 41.

As illustrated in FIGS. 1 and 2, the upper cover 21 is spaced apart from and covers the actuating member 30 and the upper side of the driving motor 50, and fixed to the upper side of the main body 10 by plural fixing screws 22.

The door opening device 20 includes switches 16 and 17 respectively installed to the handles 14 and 15 of the first and second doors 11 and 12. The switches 16 and 17 may be sensors to detect that a user holds the handles 14 and 15 or a power switch to be directly opened and closed such that power is supplied to the driving motor 50.

Operation of the door opening device 20 will be described as follows.

As illustrated in FIG. 3, if the handles 14 and 15 are not held when the first and second doors 11 and 12 are closed, the driving motor 50 does not work. Thus, the initial state is maintained. In other words, the first extending part 31 of the actuating member 30 is positioned at the central position of one of the spacing portions 42 of the rotation cam 40.

As illustrated in FIG. 4, if the user holds or pulls the handle 14 of the first door 11 to open the first door 11, the switch 16 is activated to drive the driving motor 50. At this time, since the rotation cam 40 rotates forward (clockwise) due to the driving motor 50 and one of the protrusions 41 pushes the first extending part 31 of the actuating member 30, the actuating member 30 rotates counterclockwise. Thus, the second extending part 32 pushes the inner side of the door 11, resulting in easy opening of the first door 11. As illustrated in FIG. 6, when the rotation cam 40 rotates by 120 degrees clockwise and the position detecting sensor 44 detects the magnets 43 disposed to the protrusions 41, the driving motor 50 is stopped. In this state, since the rotation cam 40 has been rotated by 120 degrees, this state is the same as the initial state. On the other hand, the actuating member 30 returns to the initial state due to the elasticity of the return spring 25 when the pressure of the first extending part 31 by the protrusions 41 of the rotation cam 40 is released. As such, since the door opening device 20 can open the doors only by the rotation of the driving motor 50 for a predetermined section in one direction and returns to the initial state, the driving motor 50 can be driven a minimal number of times. Thus, the lifespan of the driving motor 50 and its related components can be prolonged.

As illustrated in FIG. 6, when the user holds or pulls the handles 15 of the second door 12 to open the second door 12, the switch 17 is activated to drive the driving motor 50 in reverse. At this time, since the rotation cam 40 rotates counterclockwise in reverse due to the driving motor 50 and one of the protrusions 41 pushes the first extending part 31 of the actuating member 30, the actuating member rotates clockwise. Thus, in this case, the third extending part 33 pushes the inner side of the second door 12 to open the second door 12. In this case, the third extending part 33 pushes the inner side of the second door 12 to open the second door 12. After opening the second door 12, the rotation cam 40 rotates by 120 degrees and is stopped, and the actuating member 30 returns to the initial state due to the elasticity of the return spring 25. As such, since the driving motor 50 rotates once in any one direction to sufficiently open the respective doors 11 and 12, the operation of the driving motor 50 can be minimized.

In a case when the first and second doors 11 and 12 are sequentially opened, both of the doors 11 and 12 can be opened by only the clockwise and counterclockwise rotations of the driving motor 50. Thus, in comparison to the conventional art, the time of operation of the driving motor 50 can be significantly reduced as well and the two doors 11 and 12 can be rapidly opened as a result.

The operation of the door opening device 20, as illustrated in the block diagram of FIG. 7, is performed as follows. When door opening signals are inputted via the switches 16 and 17, a controller 100 transmits a signal to control the driving motor 50 to a motor driving unit 150 in accordance with a program stored in a memory 130 using information transmitted from the position detecting unit 110 and a timer 140.

Moreover, the controller 100 determines whether the driving motor 50 is driven or not, using the information transmitted from a door opening sensor 120 to detect whether the two doors 11 and 12 are opened or not, when the door opening signals are input.

Meanwhile, the controller 100 determines the door opening device 20 is malfunctioning or not in an initial state when power is supplied, or during operation of the door opening device 20, and transmits a control signal to indicate the malfunction to a display 160 when the door opening device 20 is malfunctioning.

Figure 8:
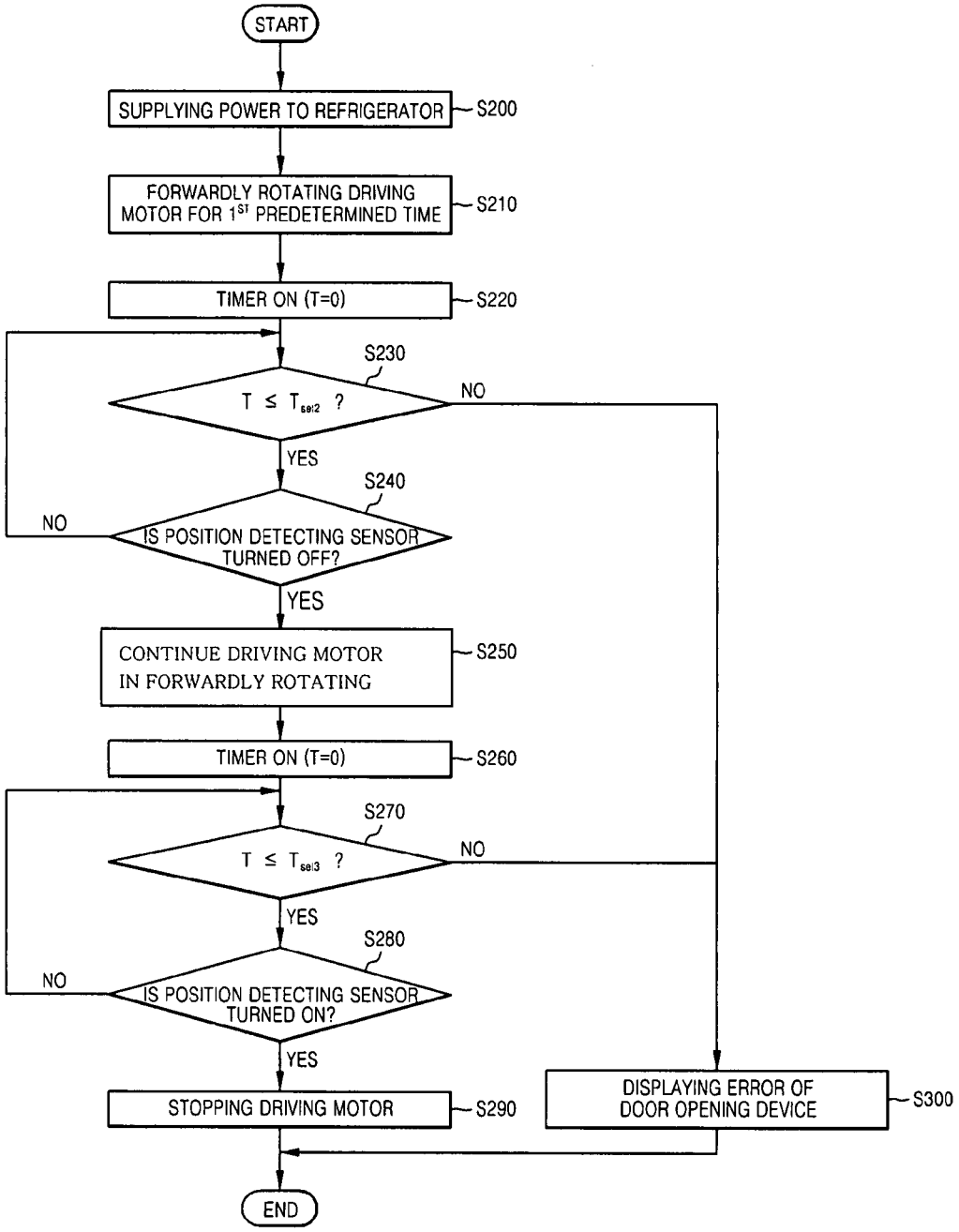
FIG. 8 is a flowchart illustrating an initial malfunction diagnosing method of the door opening device according to the first embodiment of the present invention.

FIG. 8 is a flowchart illustrating an initial malfunction diagnosing method of the door opening device 20 according to the first embodiment of the present invention.

When power is supplied to the refrigerator (S200), the controller 100 transmits a signal to rotate the driving motor 50 clockwise for a first predetermined time to the motor driving unit 150 (S210). The reason that this operation is performed will be described later.

When operation S210 is completed, the controller 100 continues to rotate the driving motor and operates the timer 140 (S220), and determines whether rotation time T of the driving motor 50 exceeds a second predetermined time (S230).

If the rotation time T of the driving motor 50 does not exceed the second predetermined time in operation S230, the controller 100 determines whether the position detecting sensor 44, the reed switch, is turned off. If not, the operation S230 is performed again. If it is determined to be turned off, the controller 100 continues to rotate the driving motor 50 forward (S240 and S250).

Meanwhile, if the rotation time T of the driving motor 50 exceeds the second predetermined time while the off state of the position detecting sensor 44 is not detected in operation S230, the controller 100 transmits a signal to indicate the malfunction of the door opening device 20 to the display 160 and completes the control (S300).

If the operation S250 is completed, the controller 100 activates the timer 140 (S260), and determines whether the rotation time T of the driving motor 50 exceeds a third predetermined time (S270).

If the rotation time T of the driving motor 50 does not exceed the third predetermined time in the operation S270, the controller 100 determines whether the position detecting sensor 44 is turned on. If not, the controller 100 performs the operation S270. If the position detecting sensor 44 is turned on, the controller 100 determines a normal state of the door opening device 20 and stops the driving motor 50 (S280 and S290).

Meanwhile, if the rotation time T of the driving motor 50 exceeds the third predetermined time while the turned on state of the position detecting sensor 44 is not detected in operation S270, the controller 100 performs operation S300.

In this case, the second predetermined time and the third predetermined time are values that are obtained by experiment and stored in the memory 130, and are determined by a maximum time for the state of the position detecting sensor 44 to be changed from the turned on state to the turned off state or from the turned off state to the turned on state when the door opening device 20 is normal.

In this embodiment, the driving motor 50 is stopped when the position detecting sensor (reed switch) 44 is turned on after opening the doors 11 and 12. Also, there is the case where the driving motor 50 further rotates in the rotation direction due to inertia despite of a stopping signal and then stops in the off state.

Thus, if the driving motor 50 stops at the position in the reverse rotation direction before power is supplied to the refrigerator in operation S200, since the off state is spontaneously changed to the on state and is detected when the diagnosis for the malfunction is performed in the forward rotation direction, as this embodiment, the reliable diagnosis for the malfunction cannot be performed. Therefore, in this embodiment, the operation S210 is performed such that the diagnosis for the malfunction is performed after the effect of the inertia.

In this case, the first predetermined time is a value obtained by experiment and is stored in the memory 130, and a rotation time of considering the separation from the stopping position of the driving motor 50 occurring when the door opening device 20 is normal.

Meanwhile, although a case where the initial diagnosis of the malfunction is performed when the driving motor 50 rotates forward is described in this embodiment, the driving motor 50 may rotate in either the forward or reverse direction.

Figure 9:
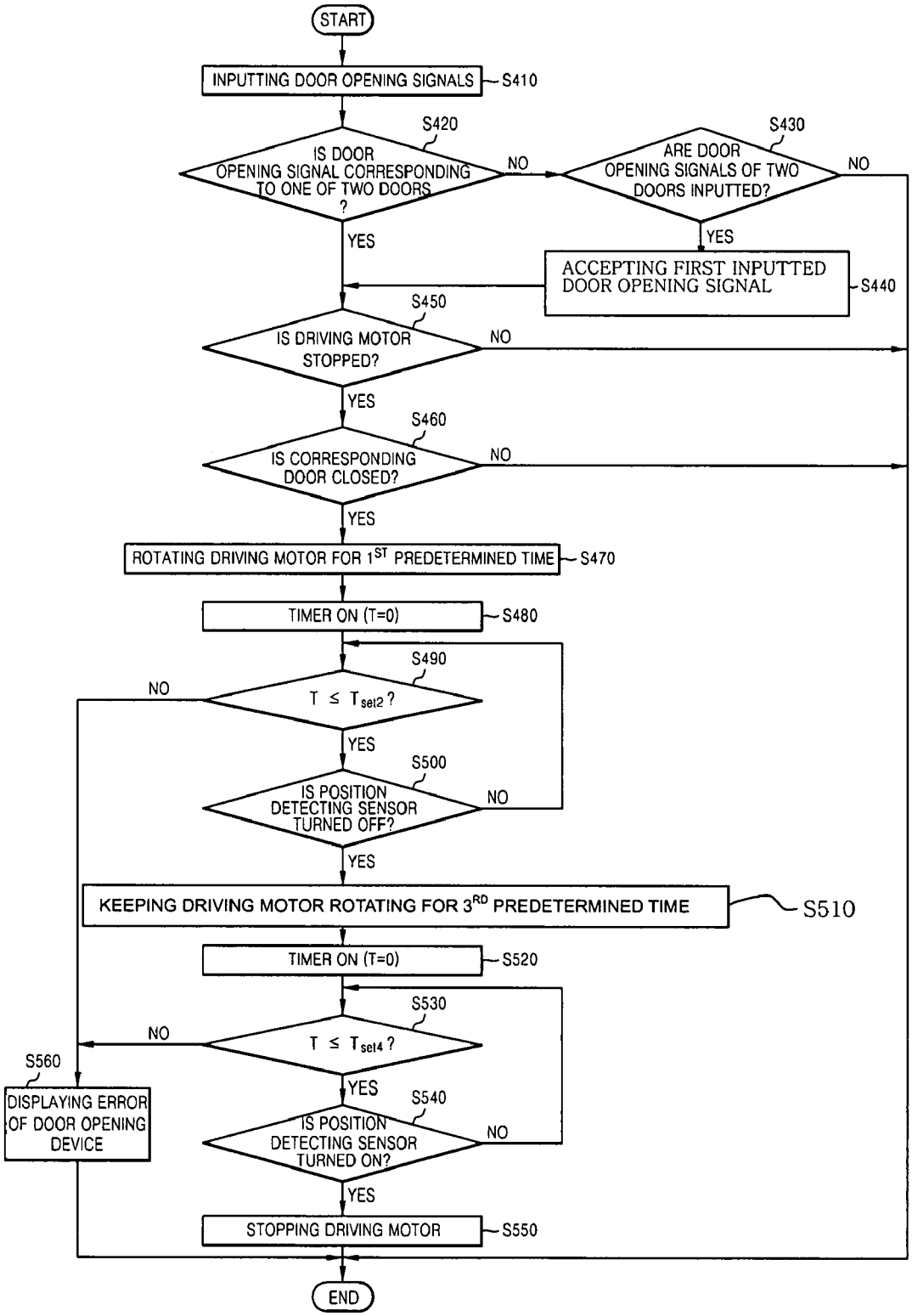
FIG. 9 is a flowchart illustrating a control method of a door opening device according to a second embodiment of the present invention.

FIG. 9 is a flowchart illustrating a control method of a door opening device 20 according to a second embodiment of the present invention, and since the configuration, the operation, and the control method of the refrigerator are similar to those of the first embodiment, the duplicated description will be omitted.

When a door opening signal is input via the switches 16 and 17 (S410), the controller 100 determines which of doors corresponds to the door opening signal (S420).

If the door opening signal is to open any one of the two doors 11 and 12 in operation S420, the controller 100 determines whether the driving motor 50 is stopped or not (S450). If the stopped state of the driving motor 50 is determined as a result of the determination in operation S450, the controller 100 determines whether the door 11 or 12 is closed or not. If closed, the controller 100 rotates the driving motor 50 in the direction where the door 11 or 12 is opened for the first predetermined time (S460 and S470).

At this time, whether the doors 11 and 12 are closed or not is determined according to the information transmitted from the door opening sensor 120, and since the first predetermined time is identical to that of the initial diagnosis, a duplicated description will be omitted.

Meanwhile, if door opening signals of opening both of the two doors 11 and 12 are inputted in operation S420, the controller 100 determines whether the two signals are sequentially inputted (S430). If sequentially inputted, the controller 100 accepts only a first inputted door opening signal to perform the operation S450 and excludes the other door opening signal (S440).

If two door opening signals are inputted simultaneously in the operation S430, the controller 100 does not accept both of the signals. However, this case may be implemented in another embodiment in which it is possible to accept a door opening signal of opening any one of the two doors, basically preset in the memory 130 and the return to the operation S450 is identical to the above case.

Moreover, as a result of the determination in the operation S450, if not stopped, the controller 100 determines the door opening device 20 is being driven and does not accept the door opening signal.

Further, as a result of the determination in the operation S460, if the corresponding door 11 or 12 is opened, the controller 100 determines the signal is undesired and does not accept the currently inputted door opening signal.

Meanwhile, when operation S470 is completed, the controller 100 keeps the driving motor 50 rotating and activates the timer 140 (S480), and determines whether the rotation time T of the driving motor 50 exceeds the second predetermined time (S490).

If the rotation time T of the driving motor 50 does not exceed the second predetermined time in operation S490, the controller 100 determines whether the position detecting sensor 44, i.e., the reed switch, is turned off or on. If not off, the controller 100 performs the operation S490 again. If off, the controller 100 keeps the driving motor 50 rotating for the third predetermined time regardless of turning on or off of the position detecting sensor 44 (S500 and S510).

At this time, the reason for keeping the driving motor 50 rotating for the third predetermined time is to prevent the driving motor 50 from malfunctioning due to chattering.

The chattering phenomenon occurs when electric contacts contact each other and are separated from each other abnormally for a very short time due to mechanical vibration. In this embodiment, if the off state of the position detecting sensor 44 is spontaneously changed to the on state due to the chattering, since the controller 100 may determine the door is opened by the rotation of the driving motor 50 even though the driving motor 50 does not actually rotate to open the doors 11 and 12, the controller 100 performs operation S510 in order to prevent this phenomenon.

Meanwhile, if the rotation time T of the driving motor 50 exceeds the second predetermined time without detection of the turned off state of the position detecting sensor 44 in the operation S490, the controller 100 transmits a signal indicating the malfunction of the door opening device 20 to the display 160 and completes the control (S560).

When the operation S510 is completed, the controller 100 activates the timer 140 (S520) and determines whether the rotation time T of the driving motor 50 exceeds a fourth predetermined time (S530).

If the rotation time T of the driving motor 50 does not exceed the fourth predetermined time in the operation S530, the controller 100 determines whether the position detecting sensor 44 is turned on. If not turned on, the controller 100 performs the operation S530 again, and if turned on, the controller 100 determines the door 11 or 12 is opened and stops the driving motor 50 (S540 and S550).

Meanwhile, if the rotation time T of the driving motor 50 exceeds the fourth predetermined time without recognizing the turned on state of the position detecting sensor 44 in the operation S530, the controller 100 performs the operation S560.

In this case, the second predetermined time and the fourth predetermined time are values obtained by experiment and are stored in the memory 130, and are determined by a maximum time taken for the state of the position detecting sensor 44 to be changed from the turned on state to the turned off state or from the turned off state to the turned on state when the door opening device 20 is normal.

Figure 10:
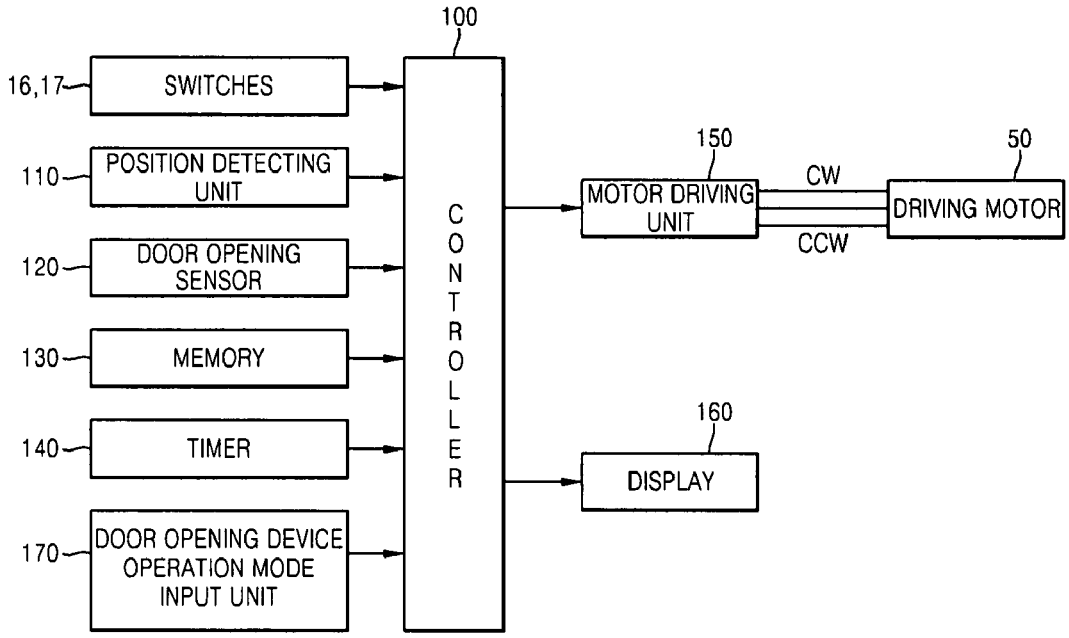
FIG. 10 is a block diagram illustrating control of operation of a door opening device according to a third embodiment of the present invention.

FIG. 10 is a block diagram illustrating control of operation of a door opening device according to a third embodiment of the present invention, and since the configuration and the operation of the refrigerator are similar to those of the first embodiment, the duplicated description will be omitted. Moreover, in the block diagram of FIG. 10, identical reference numerals are assigned to the same components as in the first embodiment.

As illustrated in FIG. 10, when door opening signals are inputted via the switches 16 and 17, the controller 100 transmits a signal to control the driving motor 50 to the motor driving unit 150 in accordance with a program stored in a memory 130 using information transmitted from the position detecting unit 110 and the timer 140.

Moreover, the controller 100 determines whether the driving motor 50 is driven or not using the information transmitted from a door opening sensor 120 to detect whether the two doors 11 and 12 are opened or not when the door opening signals are inputted.

Meanwhile, the controller 100 determines frequency of the opening of the doors due to the door opening device 20 to determine whether a locking function is to be set for the protection of the door opening device 20, and as a result of the determination, transmits a control signal indicating whether the door opening device 20 is in a locking mode that the locking function is set or in a release mode that the locking function is released to the display 160.

Moreover, the controller 100 first performs an inputted operation mode when a control signal for which the user selects one operation mode of the locking mode and a driving mode of the door opening device 20 is inputted to an operation mode input unit 170.

Figure 11:
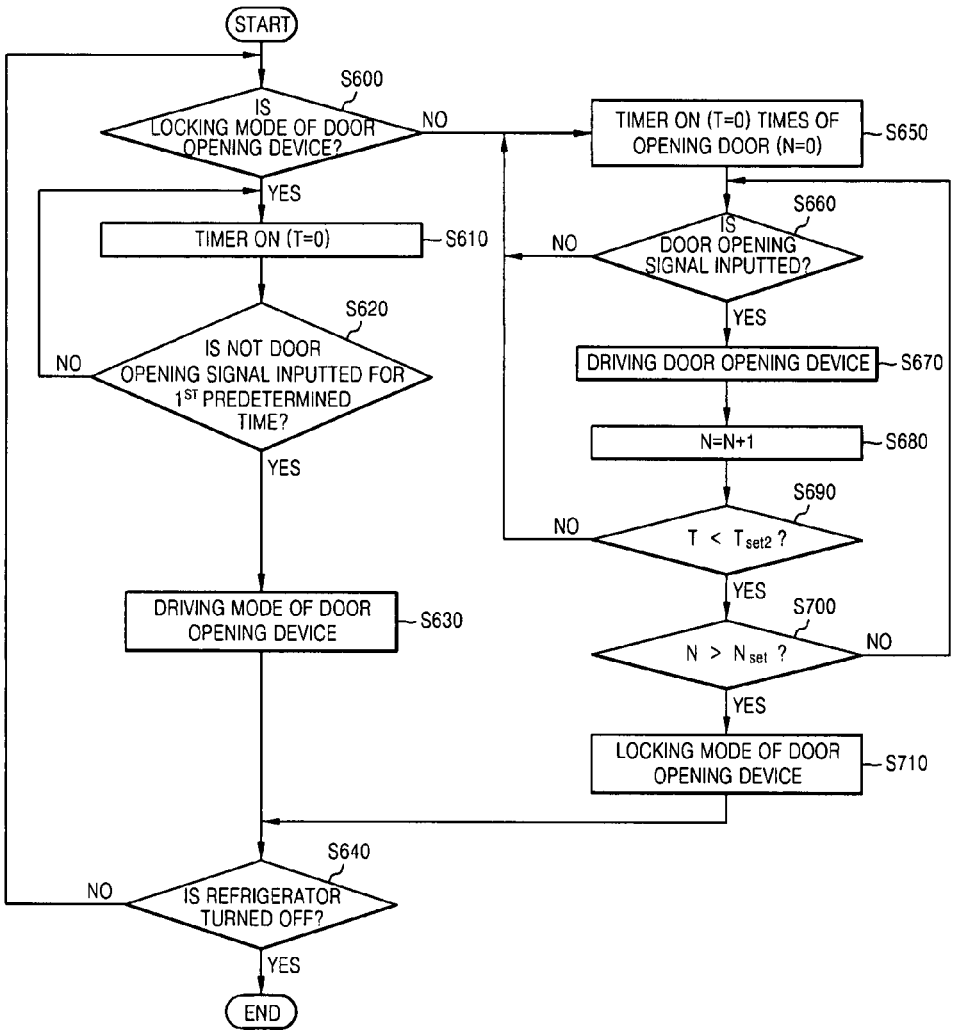
FIG. 11 is a flowchart illustrating a control method of the door opening device according to the third embodiment of the present invention.

FIG. 11 is a flowchart illustrating a control method of the door opening device 20 according to the third embodiment of the present invention.

The controller 100 determines whether the door opening device 20 is in the locking mode (S600), and if the locking mode, activates the timer 140 to determine whether the door opening signal is inputted for the first predetermined time (S610 and S620).

If the door opening signal is inputted for the first predetermined time $T_{set1}$ as a result of the determination in the operation S620, the controller 100 performs the operation S610 again, and if not inputted, releases the locking mode of the door opening device 20 to the operation mode and displays the mode change on the display 160 (S630).

In this case, the first predetermined time $T_{set1}$ is a value obtained by experiment and is stored in the memory 130, and is determined by a time required to protect the door opening device 20 from excessive operation.

If the operation S630 is completed, the controller 100 determines whether a power off signal for the refrigerator is inputted (S640), completes the control when the power off signal is inputted, and performs the operation S600 again when the power off signal is not inputted.

Meanwhile, if the door opening device 20 is not in the locking mode in the operation S600, the controller 100 drives the door opening device 20 in order to open the door 11 or 12 corresponding to the door opening signal inputted to the switches 16 and 17 and determines the frequency of the opening of the doors 11 and 12 (S650 to S700).

If the doors 11 and 12 are opened less than a predetermined number of times $N_{set}$ for the second predetermined time $T_{set2}$ as result of the determination, the controller 100 performs the operation S650 to determine the frequency of the opening of the doors 11 and 12 again, and if the opening frequency of the doors 11 and 12 exceeds the predetermined times $N_{set}$, the controller 100 changes the mode of the door opening device 20 to the locking mode in order to protect the door opening device 20 and displays the mode change on the display 160 (S710).

In this case, the second predetermined time $T_{set2}$ and the predetermined times $N_{set}$ are values obtained by experiment and are stored in the memory 130, and are determined by values determining that the door opening device 20 is being excessively driven.

If the operation S710 is completed, the controller 100 determines whether the power off signal of the refrigerator is inputted (S640). If inputted, the control is completed, and if not, the operation S600 is performed again.

The above-described control method relates to a protecting program of the door opening device 20 applied in accordance with the operation frequency of the door opening device 20, and as described above, if the user inputs a control signal of selecting any one operation mode of the locking mode and the driving mode of the door opening device 20 to the operation mode input unit 170, the inputted operation mode is first performed.

As described above, although the refrigerator and the control method thereof are described to be implemented by the first to third embodiments independently, it could be understood that if necessary, the refrigerator and the control method thereof can be implemented by combining features of the plural embodiments.

As described above, the door opening device of a refrigerator according to the embodiments of the present invention can open the doors using only the rotation of the driving motor in one direction by a predetermined section, can return to the initial state without the reverse rotation of the driving motor after the opening of the doors, and can open the two doors using only the forward and reverse rotation of the driving motor even when the first and second doors are sequentially opened. Therefore, the control of the driving motor can be minimized so that life spans of the driving motor and the related components can be prolonged.

Moreover, according to the refrigerator and the control method thereof of the embodiments of the present invention, the position of the rotation cam is detected at the initial state when the power is supplied or during the operation to determine whether the door opening device is malfunctioning. In the early time when the position of the rotation cam is detected, the driving motor is rotated by force so that the malfunction of the driving motor due to the chattering can be prevented.

Further, according to the refrigerator and the control method thereof of the present invention, the frequency of the opening of the doors by the door opening signal is determined and the door opening device is driven in the locking mode or the release mode in accordance with the determination so that the door opening device can be prevented from being damaged due to the excessive operation.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body defining first and second compartments therein;

first and second doors to respectively open and close the first and second compartments;

a door opening device comprising:

a switch to input a plurality of door opening signals respectively corresponding to the first and second doors to respectively open the first and second doors, an actuating member to rotate to selectively open the first and second doors, a rotation cam to contact and rotate the actuating member, a driving motor to rotate the actuating member by rotating the rotation cam, and a return device to return the actuating member to an initial position after opening one of the first and second doors; and a controller to rotate the driving motor in a first direction in order to open the door corresponding to the accepted door opening signal, wherein the controller accepts only a first inputted one of the door opening signals when the door opening signals are inputted to the switch wherein the actuating member includes at least one first extending part extended from a center of rotation to the rotation cam, a second extending part extended from the center of rotation toward the inside of the first door, and a third extending part extended from the center of rotation toward the inside of the second door.

2. The refrigerator according to claim 1, wherein the rotation cam includes a plurality of protrusions to contact and rotate the actuating member and a plurality of spacing portions spaced apart from the actuating member, the protrusions and the spacing portions being alternately disposed in a rotation direction, the driving motor rotates the rotation cam forward and in reverse, and the return device returns the actuating member to an initial position after opening one of the first and second doors.

3. The refrigerator according to claim 2, wherein the controller disregards the door opening signals for the first and second doors when the door opening signals are inputted simultaneously.

4. The refrigerator according to claim 2, wherein the controller accepts only the door opening signal corresponding to a preset one of the first and second doors when the door opening signals are inputted simultaneously.

5. The refrigerator according to claim 4, wherein, when the accepted door opening signal is inputted during the rotation of the driving motor, the controller disregards the inputted door opening signal.

6. The refrigerator according to claim 5, further comprising a door opening sensor to detect whether the doors are opened;

wherein, the controller disregards the inputted door opening signal when the door opening sensor detects the door corresponding to the inputted door opening signal is open.

7. The refrigerator according to claim 6, wherein the door opening device further comprises a position detecting unit to detect a rotation position of the rotation cam to control the driving motor, the position detecting unit having a portion contacting the protrusions during the rotation of the actuating member and being positioned opposite a first one of the protrusions of the rotation cam at the initial state when the door opening signal is not accepted, and the controller determines the rotation position of the rotation cam detected by the position detecting unit when any one of the door opening signals is accepted, and rotates the driving motor in the first direction such that the rotation cam rotates until the protrusion initially adjacent the first one of the protrusion detecting unit is rotated to be opposite the position detecting unit.

8. The refrigerator according to claim 7, wherein the position detecting unit comprises magnets disposed at leading edges of the respective protrusions and a detecting sensor installed to an outer side of the rotation cam to detect the magnets.

9. The refrigerator according to claim 8, further comprising a display to display a malfunction of the door opening device, wherein the controller determines the door opening device has malfunctioned when the protrusion adjacent to the first protrusion is not detected within a first predetermined time and controls the display to display the malfunction.

10. The refrigerator according to claim 9, wherein the controller rotates the driving motor for a second predetermined time before detecting the rotation position of the rotation cam when the door opening signals are accepted.

11. The refrigerator according to claim 10, wherein the controller disregards the rotation position of the rotation cam for a third predetermined time and rotates the driving motor in the first direction when the spacing portions are detected during the rotation of the driving motor.

12. The refrigerator according to claim 11, wherein, when electric power is supplied to the refrigerator, the controller rotates the driving motor in either the first or second direction until the protrusion adjacent to the first protrusion is detected for an initial malfunction diagnosis.

13. The refrigerator according to claim 12, wherein, when the protrusion adjacent the first protrusion is not detected within the first predetermined time during the initial malfunction diagnosis, the controller determines the door opening device malfunctioned and controls the display to display the malfunction.

14. The refrigerator according to claim 13, wherein the controller, in the initial malfunction diagnosis, first rotates the driving motor for the second predetermined time before detecting the rotation position of the rotation cam.

15. The refrigerator according to claim 14, wherein the controller determines a frequency of the opening of the doors due to the door opening signals inputted to the switches during the control of the door opening device, and when the frequency is greater than a set number of occurrences during a fourth predetermined time, the controller performs a locking mode of the door opening device that the door opening device is not operated even when the door opening signals are inputted.

16. The refrigerator according to claim 15, wherein, when the door opening signals are not inputted for a fifth predetermined time while the locking mode of the door opening device is performed, the controller performs a driving mode of the door opening device that the locking mode of the door opening device is released and the door opening device is driven in accordance with an inputted door opening signal.

17. The refrigerator according to claim 16, further comprising an input unit to input any one operation mode of the locking mode and the driving mode of the door opening device, wherein, when the operation mode is inputted to the input unit by a control signal of a user, the controller firstly performs the inputted operation mode regardless of the frequency that the doors are opened by the door opening signals.

18. The refrigerator according to claim 17, wherein, when the locking mode or the driving mode of the door opening device is performed, the controller controls the display to display the performing operation mode.

19. A method of controlling a refrigerator having a first door and a second door to respectively open and close the first and second compartments, and a door opening device including a switch to input a plurality of door opening signals respectively corresponding to the first and second doors to respectively open the first and second doors, an actuating member to rotate to selectively open the first and second doors, a rotation cam including a plurality of protrusions to contact and rotate the actuating member and a plurality of spacing portions spaced apart from the actuating member, the protrusions and the spacing portions being alternately disposed in a rotation direction, a driving motor to rotate the rotation cam forward and in reverse, and a return device to return the actuating member to an initial position after opening one of the first and second doors, the method comprising:

controlling the door opening device in accordance with the door opening signals when the door opening signals are inputted to the switch; and when the plurality of the door opening signals for the first and second doors are inputted, accepting only a first inputted one of the door opening signals and rotating the driving motor in a first direction only in order to open the door corresponding to the accepted door opening signal wherein the actuating member includes at least one first extending part extended from a center of rotation to the rotation cam, a second extending part extended from the center of rotation toward the inside of the first door, and a third extending part extended from the center of rotation toward the inside of the second door.

20. The method of controlling a refrigerator according to claim 19, comprising disregarding the door opening signals for the two doors or accepting only one of the door opening signals corresponding to a preset one of the two doors when the door opening signals are inputted simultaneously.

21. The method of controlling a refrigerator according to claim 20, wherein, when the door opening signal is inputted during the rotation of the driving motor, the method further comprises disregarding the inputted door opening signal.

22. The method of controlling a refrigerator according to claim 21, further comprising detecting whether a door corresponding to the inputted door opening signal is opened, and if the corresponding door is opened, the inputted door opening signal is disregarded.

23. The method of controlling a refrigerator according to claim 22, wherein the door opening device further comprises a position detecting sensor to detect a position of the rotation cam, the position detecting sensor being opposite a first one of the protrusions, when the door opening signal is accepted, method further comprises detecting the rotation position of the rotation cam, and the driving motor is rotated in a first direction such that the rotation cam rotates until a second one of the protrusions is opposite the position detecting sensor, the second protrusion being adjacent the first protrusion.

24. The method of controlling a refrigerator according to claim 23, wherein, the position detecting unit further comprises a detecting sensor, installed to an outer side of the rotation cam the method further comprising detecting magnets disposed at leading edges of the respective protrusions.

25. The method of controlling a refrigerator according to claim 24, wherein, when the second protrusion is not detected within a first predetermined time the method further comprises determining that the door opening device is malfunctioning and the malfunctioned state is displayed.

26. The method of controlling a refrigerator according to claim 25, wherein, when the door opening signals are accepted, the method further comprises rotating the driving motor for a second predetermined time before detecting the rotation position of the rotation cam.

27. The method of controlling a refrigerator according to claim 26, wherein, when the spacing portions are detected during the rotation of the driving motor, the method further comprises disregarding the rotation position of the rotation cam for a third predetermined time and rotating the driving motor in the first direction.

28. The method of controlling a refrigerator according to claim 27, wherein, when electric power is supplied to the refrigerator, the method further comprises performing an initial malfunction diagnosis while rotating the driving motor in any direction until the second protrusion disposed next to a current position is detected.

29. The method of controlling a refrigerator according to claim 28, wherein, when the second protrusion is not detected within the first predetermined time during the initial malfunction diagnosis, the method further comprises determining that the door opening device is malfunctioning and the display displays the malfunction.

30. The method of controlling a refrigerator according to claim 29, wherein the method further comprises rotating in the performing the initial malfunction diagnosis, the driving motor is for the second predetermined time before detecting the rotation position of the rotation cam.

31. The method of controlling a refrigerator according to claim 30, wherein, when the frequency of the opening of the doors due to the door opening signals is determined during the control of the door opening device, and the frequency is greater than a predetermined times for a fourth predetermined time, the method comprises not operating a locking mode of the door opening device even when the door opening signals are inputted.

32. The method of controlling a refrigerator according to claim 31, wherein, when the door opening signals are not inputted for a fifth predetermined time while the locking mode of the door opening device is performed, the method comprises performing a driving mode of the door opening device that the locking mode of the door opening device is released and the door opening device is driven in accordance with an inputted door opening signal.

33. The method of controlling a refrigerator according to claim 32, wherein, when the operation mode is inputted by a control signal of a user, the method comprises performing the inputted operation mode is firstly performed regardless of the frequency that the doors are opened by the door opening signals.

* * * * *

UNITED STATES PATENT AND TRADEMARK OFFICE

CERTIFICATE OF CORRECTION

PATENT NO. : 8,099,970 B2
APPLICATION NO. : 11/984313
DATED : January 24, 2012
INVENTOR(S) : Sung Ho Cho et al.

It is certified that error appears in the above-identified patent and that said Letters Patent is hereby corrected as shown below:

On the Title page, Item (75) (Inventors), Line 2, Delete "Hem" and insert -- Hern --, therefor.

Signed and Sealed this
Tenth Day of July, 2012

David J. Kappos

David J. Kappos
*Director of the United States Patent and Trademark Office*